US012680174B2

(12) United States Patent
Yanagisawa et al.

(10) Patent No.: US 12,680,174 B2
(45) Date of Patent: Jul. 14, 2026

(54) ELECTROSYNTHESIS SYSTEM

(71) Applicant: HONDA MOTOR CO., LTD., Tokyo (JP)

(72) Inventors: Kazuki Yanagisawa, Wako (JP); Masahiro Mohri, Wako (JP); Misato Maki, Wako (JP); Hideaki Yoneda, Wako (JP); Jumpei Yoshida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 531 days.

(21) Appl. No.: 18/204,606

(22) Filed: Jun. 1, 2023

(65) Prior Publication Data

US 2023/0392266 A1 Dec. 7, 2023

(30) Foreign Application Priority Data

Jun. 7, 2022 (JP) ..... JP2022-092312

(51) Int. Cl.

| | |
|---|---|
| ***C25B 9/00*** | (2021.01) |
| ***C25B 1/02*** | (2006.01) |
| ***C25B 1/042*** | (2021.01) |
| ***C25B 1/23*** | (2021.01) |
| ***C25B 3/03*** | (2021.01) |
| ***C25B 15/08*** | (2006.01) |

(52) U.S. Cl.

CPC ..... *C25B 1/042* (2021.01); *C25B 1/02* (2013.01); *C25B 1/23* (2021.01); *C25B 3/03* (2021.01); *C25B 15/083* (2021.01)

(58) Field of Classification Search

CPC ..... C25B 1/042; C25B 15/083; C25B 1/23; C25B 3/03; C25B 1/02

See application file for complete search history.

(56) References Cited

U.S. PATENT DOCUMENTS

2022/0136119 A1* 5/2022 Flanders ..... C12P 7/06 435/71.1
2022/0316077 A1* 10/2022 Mohri ..... C25B 15/087

FOREIGN PATENT DOCUMENTS

JP 2022-022978 A 2/2022

* cited by examiner

*Primary Examiner* — Zulmariam Mendez

(74) *Attorney, Agent, or Firm* — Carrier, Shende & Associates P.C.; Joseph P. Carrier; Jeffrey T. Gedeon

(57) ABSTRACT

An electrosynthesis system is equipped with an adjustment device that adjusts a flow rate of a hydrogen gas supplied from a hydrogen gas storage device to a generated gas flow path, and a flow rate of a carbon monoxide gas supplied from the carbon monoxide gas storage device to the generated gas flow path, based on a detection result of a first concentration sensor, in a manner so that the hydrogen gas and the carbon monoxide gas are supplied to a hydrocarbon synthesizing device at a predetermined concentration ratio.

5 Claims, 9 Drawing Sheets

ELECTROSYNTHESIS SYSTEM

CROSS-REFERENCE TO RELATED APPLICATIONS

This application is based upon and claims the benefit of priority from Japanese Patent Application No. 2022-092312 filed on Jun. 7, 2022, the contents of which are incorporated herein by reference.

BACKGROUND OF THE INVENTION

Field of the Invention

The present invention relates to an electrosynthesis system.

Description of the Related Art

In recent years, efforts have been actively made to significantly reduce the generation of waste by preventing or reducing the generation of such waste, as well as recycling and reusing such waste. Toward the realization thereof, research and development are being carried out in relation to an electrosynthesis system. An electrosynthesis system is a system in which water vapor and carbon dioxide gas are subjected to electrolysis, and a hydrocarbon such as methane or the like is synthesized based on hydrogen gas and carbon monoxide gas obtained by the electrolysis.

In JP 2022-022978 A, a method for the co-production of methanol and methane is disclosed. Such a method includes an electrolysis step and a methane synthesis step. In the electrolysis step, water vapor and carbon dioxide gas are reduced in a solid oxide electrolytic cell, whereby hydrogen gas and carbon monoxide gas are generated. In the methane synthesis step, using a methanation catalyst, methane is synthesized from the hydrogen gas and the carbon monoxide gas that were generated in the electrolysis step.

SUMMARY OF THE INVENTION

In the methane synthesis process of JP 2022-022978 A, a chemical reaction formula of the synthesis reaction is "$3H_2+CO \rightarrow CH_4+H_2O$". Therefore, in order to increase the efficiency of the synthesis of methane in the methane synthesis step of JP 2022-022978 A, it is desirable for the ratio of the hydrogen gas to the carbon monoxide gas obtained in the electrolysis step of JP 2022-022978 A to be "3:1".

However, in general, the concentration ratio between the hydrogen gas and the carbon monoxide gas obtained in an electrolysis process tends to fluctuate due to various factors, such as deterioration of the solid oxide electrolytic cell or the like. In the case that the concentration ratio between the hydrogen gas and the carbon monoxide gas obtained in the electrolysis step fluctuates, a problem arises in that the efficiency of the synthesis of hydrocarbons such as methane or the like that are synthesized from the hydrogen gas and the carbon monoxide gas is reduced.

The present invention has the object of solving the aforementioned problems.

An aspect of the present invention is characterized by an electrosynthesis system comprising an electrolysis device configured to perform electrolysis on a raw material gas containing carbon dioxide gas and water vapor, and thereby generate a generated gas containing hydrogen gas and carbon monoxide gas, a hydrocarbon synthesizing device configured to synthesize hydrocarbons based on the generated gas, and a generated gas flow path connected to the electrolysis device and the hydrocarbon synthesizing device, the electrosynthesis system further comprising a hydrogen gas storage device configured to be capable of storing the hydrogen gas, a carbon monoxide gas storage device configured to be capable of storing the carbon monoxide gas, a first concentration sensor configured to detect a first concentration, which is a concentration of one of the hydrogen gas and the carbon monoxide gas flowing through the generated gas flow path, and an adjustment device configured to adjust a flow rate of the hydrogen gas supplied from the hydrogen gas storage device to the generated gas flow path, and a flow rate of the carbon monoxide gas supplied from the carbon monoxide gas storage device to the generated gas flow path, based on a detection result of the first concentration sensor, in a manner so that the hydrogen gas and the carbon monoxide gas are supplied to the hydrocarbon synthesizing device at a predetermined concentration ratio.

In accordance with the above-described aspect, the hydrogen gas and the carbon monoxide gas can be supplied to the hydrocarbon synthesizing device at appropriate proportions. Accordingly, hydrocarbons can be stably synthesized without waste. As a result, it is possible to suppress a decrease in the efficiency of the synthesis of hydrocarbons. Further, an exhaust gas containing carbon dioxide gas can be converted into a valuable product with high efficiency. This in turn contributes to a significant reduction in the generation of waste.

The above and other objects, features, and advantages of the present invention will become more apparent from the following description when taken in conjunction with the accompanying drawings, in which a preferred embodiment of the present invention is shown by way of illustrative example.

DETAILED DESCRIPTION OF THE INVENTION

Embodiment

Figure 1:
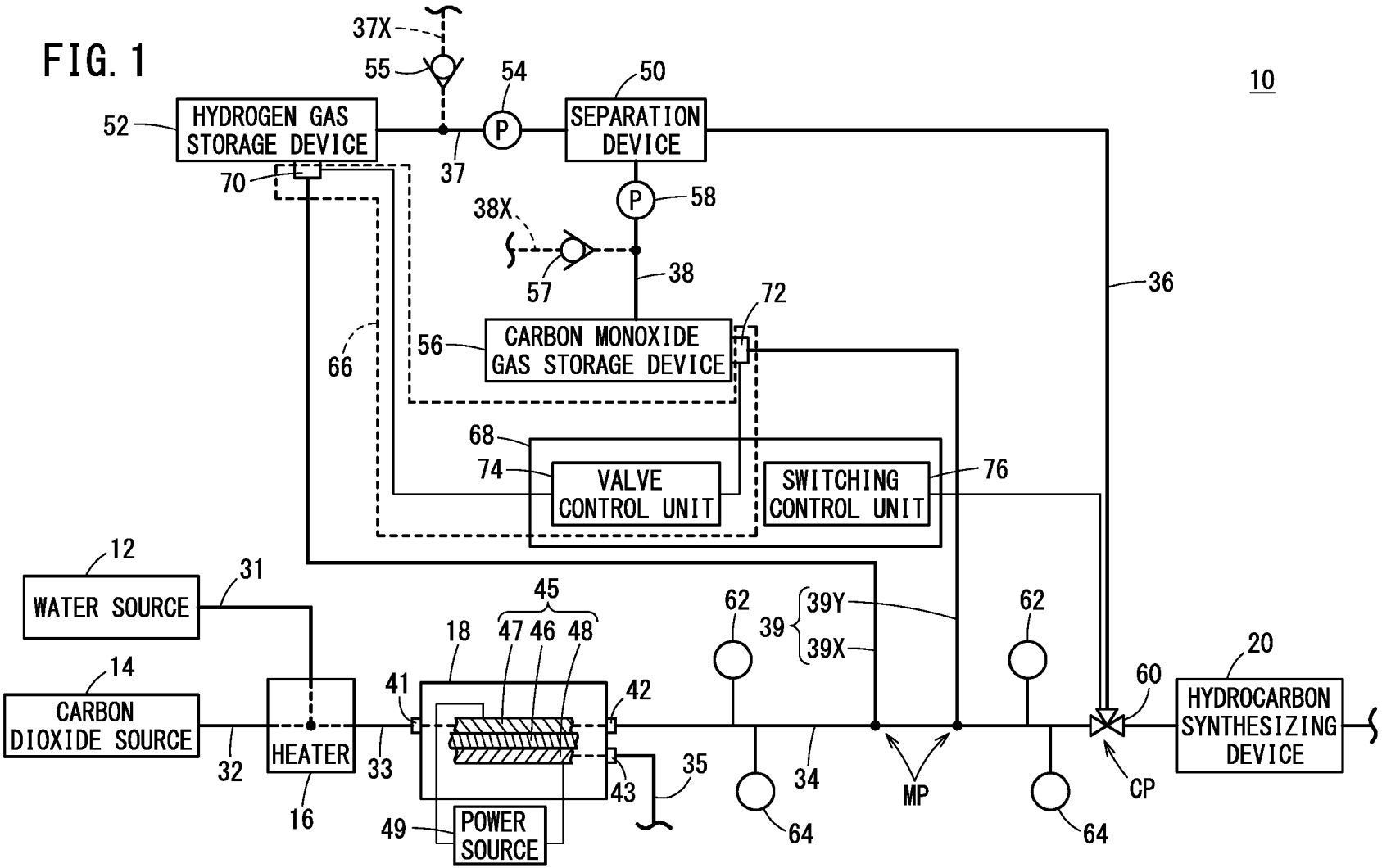
FIG. 1 is a schematic diagram showing the configuration of an electrosynthesis system according to an embodiment.

FIG. 1 is a schematic diagram showing the configuration of an electrosynthesis system 10 according to an embodiment. The electrosynthesis system 10 includes a water source 12, a carbon dioxide source 14, a heater 16, an electrolysis device 18, and a hydrocarbon synthesizing device 20.

The water source 12 outputs water, which is a source of steam (water vapor) that is supplied to the electrolysis device 18. The water source 12 may be a water supply device or a water tank. Further, the water source 12 may be a water extraction device that extracts water of a predetermined purity from a waste liquid of a plant facility.

The carbon dioxide source 14 outputs the carbon dioxide gas that is supplied to the electrolysis device 18. The carbon dioxide source 14 may be a carbon dioxide gas separator that separates carbon dioxide gas from the atmosphere. Further, the carbon dioxide source 14 may be a carbon dioxide gas extraction device that extracts carbon dioxide gas of a predetermined purity from an exhaust gas of a plant facility. Moreover, it should be noted that the carbon dioxide gas extraction device may be provided in the same plant facility as the water extraction device described above, or may be provided in a plant facility that is different from that of the water extraction device.

The heater 16 heats the fluids that flow through each of the water flow path 31, the carbon dioxide gas flow path 32, and the raw material gas flow path 33. A portion of each of the water flow path 31, the carbon dioxide gas flow path 32, and the raw material gas flow path 33 is arranged in the interior of the heater 16.

The water flow path 31 is connected to the water source 12 and the raw material gas flow path 33. The water flow path 31 allows the water supplied from the water source 12 to flow through the raw material gas flow path 33. The water that flows from the water source 12 into the water flow path 31 is heated by the heater 16, and water vapor which is vaporized due to such heating flows into the raw material gas flow path 33.

The carbon dioxide gas flow path 32 is connected to the carbon dioxide source 14 and the raw material gas flow path 33. The carbon dioxide gas flow path 32 allows the carbon dioxide gas supplied from the carbon dioxide source 14 to flow through the raw material gas flow path 33. The carbon dioxide gas that flows from the carbon dioxide source 14 into the carbon dioxide gas flow path 32 is heated by the heater 16, and flows into the raw material gas flow path 33.

The raw material gas flow path 33 is connected to each of the flow paths of the water flow path 31 and the carbon dioxide gas flow path 32, as well as to a gas inlet portion 41 of the electrolysis device 18. The raw material gas flow path 33 allows the raw material gas containing the water vapor and the carbon dioxide gas to flow therethrough. The raw material gas that flows into the raw material gas flow path 33 is heated by the heater 16, and flows into the electrolysis device 18 from the gas inlet portion 41.

The electrolysis device 18 is a device that electrolyzes the carbon dioxide gas and the water vapor. The electrolysis device 18 includes the gas inlet portion 41, a first gas outlet portion 42, a second gas outlet portion 43, and a plurality of electrolytic cells 45.

Each of the electrolytic cells 45 includes a membrane electrode assembly (MEA). The membrane electrode assembly includes an electrolyte membrane 46, a fuel electrode 47, and an oxygen electrode 48. The electrolyte membrane 46 is a solid oxide electrolyte membrane. The fuel electrode 47 may be referred to as a cathode. The oxygen electrode 48 may be referred to as an anode. An electrical power source 49 is connected to the fuel electrode 47 and the oxygen electrode 48.

The electrolysis device 18 applies a voltage supplied from the electrical power source 49 to the fuel electrode 47 and the oxygen electrode 48 of each of the electrolytic cells 45. Further, the electrolysis device 18 also supplies the raw material gas flowing from the gas inlet portion 41 to the fuel electrode 47 of each of the electrolytic cells 45.

In the case that a voltage is applied to the fuel electrode 47 and the oxygen electrode 48, and when the raw material gas is supplied to the fuel electrode 47, each of the electrolytic cells 45 begins to carry out electrolysis of the carbon dioxide gas and the water vapor contained within the raw material gas. When the electrolysis of the carbon dioxide gas and the water vapor is initiated, carbon monoxide gas and hydrogen gas are generated at the fuel electrode 47, and oxygen gas is generated at the oxygen electrode 48.

The electrolysis device 18 collects a generated gas containing the hydrogen gas and the carbon monoxide gas generated in each of the electrolytic cells 45, and outputs the generated gas to a generated gas flow path 34 from the first gas outlet portion 42. Further, the electrolysis device 18 collects the oxygen gas generated in each of the electrolytic cells 45, and outputs the oxygen gas to an oxygen gas flow path 35 from the second gas outlet portion 43.

The hydrocarbon synthesizing device 20 synthesizes hydrocarbons based on the generated gas supplied from the generated gas flow path 34. The hydrocarbon synthesizing device 20 synthesizes the hydrocarbons from the hydrogen gas and the carbon monoxide gas contained within the generated gas due to the catalytic reaction. The hydrocarbon synthesizing device 20 may generate the hydrocarbons using a Fischer-Tropsch process.

The electrosynthesis system 10 according to the present embodiment includes a separation device 50, a hydrogen gas storage device 52, a first pump 54, a carbon monoxide gas storage device 56, a second pump 58, a switching device 60, a first concentration sensor 62, a second concentration sensor 64, an adjustment device 66, and a control device 68.

The separation device 50 separates the hydrogen gas and the carbon monoxide gas from the generated gas. The generated gas is supplied from the generated gas flow path 34 via a branching flow path 36. The branching flow path 36 branches off from the generated gas flow path 34, and is connected to the separation device 50.

The separation device 50 may utilize a pressure swing adsorption method to separate the carbon monoxide gas. In this case, the separation device 50 causes an adsorption agent to adsorb the carbon monoxide gas contained within the generated gas supplied from the generated gas flow path 34, and then recovers the carbon monoxide gas adsorbed by the adsorption agent. A principal component of the remaining gas (residual gas) after the carbon monoxide gas has been separated from the generated gas supplied from the generated gas flow path 34 is hydrogen gas. The separation device 50 may extract the hydrogen gas from the residual gas, or need not necessarily extract the hydrogen gas from the residual gas.

The hydrogen gas storage device 52 is connected to the separation device 50 via a hydrogen gas flow path 37. The hydrogen gas storage device 52 stores the hydrogen gas separated by the separation device 50. As noted previously, in the case that the separation device 50 does not extract the hydrogen gas from the residual gas, the hydrogen gas storage device 52 stores the residual gas in which the hydrogen gas is contained as a principle component thereof. The hydrogen gas storage device 52 may be a tank for the purpose of storing the hydrogen gas, or may be a surge tank for the purpose of stably supplying the hydrogen gas.

The first pump 54 is installed in the hydrogen gas flow path 37. The first pump 54 imparts a fluidic force to the hydrogen gas. The hydrogen gas to which the fluidic force has been imparted by the first pump 54 flows, via the hydrogen gas flow path 37, from the separation device 50 to the hydrogen gas storage device 52. Moreover, it should be noted that the first pump 54 need not necessarily be installed.

In the case that a gas pressure inside the hydrogen gas storage device 52 exceeds a predetermined upper limit value, the gas pressure of the hydrogen gas in the hydrogen gas flow path 37 increases. When the gas pressure of the hydrogen gas in the hydrogen gas flow path 37 exceeds a predetermined gas pressure threshold value, a check valve 55 provided in a purge flow path 37X that branches off from the hydrogen gas flow path 37 opens, and the hydrogen gas is discharged from the hydrogen gas flow path 37.

The carbon monoxide gas storage device 56 is connected to the separation device 50 via a carbon monoxide gas flow path 38. The carbon monoxide gas storage device 56 stores the carbon monoxide gas separated by the separation device 50. The carbon monoxide gas storage device 56 may be a tank for the purpose of storing the carbon monoxide gas, or may be a surge tank for the purpose of stably supplying the carbon monoxide gas.

The second pump 58 is installed in the carbon monoxide gas flow path 38. The second pump 58 imparts a fluidic force to the carbon monoxide gas. The carbon monoxide gas to which the fluidic force has been imparted by the second pump 58 flows, via the carbon monoxide gas flow path 38, from the separation device 50 to the carbon monoxide gas storage device 56. Moreover, it should be noted that the second pump 58 need not necessarily be installed.

In the case that the gas pressure inside the carbon monoxide gas storage device 56 exceeds a predetermined upper limit value, the gas pressure of the carbon monoxide gas in the carbon monoxide gas flow path 38 increases. When the gas pressure of the carbon monoxide gas in the carbon monoxide gas flow path 38 exceeds a predetermined gas pressure threshold value, a check valve 57 provided in a purge flow path 38X that branches off from the carbon monoxide gas flow path 38 opens, and the carbon monoxide gas is discharged from the carbon monoxide gas flow path 38.

The switching device 60 switches the connection with the electrolysis device 18 to either one of the hydrocarbon synthesizing device 20 or the separation device 50. A switching control of the switching device 60 is executed by the control device 68. In the case that the connection with the electrolysis device 18 is switched to the hydrocarbon synthesizing device 20, the generated gas flowing through the generated gas flow path 34 flows to the hydrocarbon synthesizing device 20. In the case that the connection with the electrolysis device 18 is the separation device 50, the generated gas flowing through the generated gas flow path 34 flows, via the branching flow path 36, to the separation device 50.

The switching device 60 may be a three-way valve or a pair of opening/closing valves. In FIG. 1, an example is shown in which the switching device 60 is a three-way valve. In the case that the switching device 60 is a three-way valve, the three-way valve is provided at a connecting portion CP between the generated gas flow path 34 and the branching flow path 36. In the case that the switching device 60 is a pair of opening/closing valves, one of the pair of opening/closing valves is provided in the generated gas flow path 34 between the connecting portion CP and the electrolysis device 18. Further, the other one of the pair of opening/closing valves is provided in the branching flow path 36 between the connecting portion CP and the separation device 50.

The first concentration sensor 62 is provided in the generated gas flow path 34. The first concentration sensor 62 detects a first concentration. The first concentration is a concentration of one of the hydrogen gas and the carbon monoxide gas that flows through the generated gas flow path 34. According to the present embodiment, two of the first concentrations sensors 62 are provided. One of the two first concentration sensors 62 is provided in the generated gas flow path 34 at a position more downstream than a merging portion MP. The other one of the two first concentration sensors 62 is provided in the generated gas flow path 34 at a position more upstream than the merging portion MP.

The merging portion MP is a portion where a merging flow path 39 merges with the generated gas flow path 34. The merging flow path 39 is a flow path for allowing the hydrogen gas and the carbon monoxide gas, the flow rates of which have been adjusted by the adjustment device 66, to merge in a common flow in the generated gas flow path 34. The merging flow path 39 includes a hydrogen gas flow path 39X connected to the hydrogen gas storage device 52 and the generated gas flow path 34, and a carbon monoxide gas flow path 39Y connected to the carbon monoxide gas storage device 56 and the generated gas flow path 34.

The second concentration sensor 64 is provided in the generated gas flow path 34. The second concentration sensor 64 detects a second concentration. The second concentration is a concentration of another one of the hydrogen gas and the carbon monoxide gas that flows through the generated gas flow path 34. In the case that the second concentration is a concentration of the carbon monoxide gas, the first concentration is a concentration of the hydrogen gas. Further, in the case that the second concentration is a concentration of the hydrogen gas, the first concentration is a concentration of the carbon monoxide gas. According to the present embodiment, two of the second concentrations sensors 64 are provided. One of the two second concentration sensors 64 is provided in the generated gas flow path 34 at a position more downstream than the merging portion MP. The other one of the two second concentration sensors 64 is provided in the generated gas flow path 34 at a position more upstream than the merging portion MP.

The adjustment device 66 adjusts the flow rate of the hydrogen gas and the flow rate of the carbon monoxide gas, in a manner so that the hydrogen gas and the carbon monoxide gas are supplied at a predetermined concentration ratio to the hydrocarbon synthesizing device 20. The adjustment device 66 includes a first opening/closing valve 70, a second opening/closing valve 72, and a valve control unit 74.

The first opening/closing valve 70 is provided at an outlet portion of the hydrogen gas storage device 52. When the first opening/closing valve 70 is opened, the hydrogen gas is supplied from the hydrogen gas storage device 52 to the generated gas flow path 34.

The second opening/closing valve 72 is provided at the outlet portion of the carbon monoxide gas storage device 56. When the second opening/closing valve 72 is opened, the carbon monoxide gas is supplied from the carbon monoxide gas storage device 56 to the generated gas flow path 34.

The valve control unit 74 is provided in the control device 68. The valve control unit 74 controls the first opening/closing valve 70, and thereby causes the first opening/closing valve 70 to open and close. Further, the valve control unit 74 controls the second opening/closing valve 72, and thereby causes the second opening/closing valve 72 to open and close.

The control device 68 is a computer that controls the electrosynthesis system 10. The control device 68 is equipped with an operation unit, a storage unit, and a computation unit. The operation unit is an input device that is capable of receiving instructions from the operator. The storage unit may be constituted by a volatile memory and a non-volatile memory. As an example of the volatile memory, there may be cited a RAM or the like. As an example of the nonvolatile memory, there may be cited a ROM, a flash memory, or the like. The computation unit includes a processor such as a CPU, an MCU, or the like.

The control device 68 controls the electrolysis device 18. In the case that the electrolysis device 18 is started, the control device 68 drives the electrical power source 49, and applies a voltage to the fuel electrode 47 and the oxygen electrode 48 of each of the electrolytic cells 45. In this case, the control device 68 opens the opening/closing valve provided in the water flow path 31 at a predetermined timing, and starts to supply the water vapor to the electrolysis device 18. Further, the control device 68 opens the opening/closing valve provided in the carbon dioxide gas flow path 32 at a predetermined timing, and starts to supply the carbon dioxide gas from the carbon dioxide source 14.

The control device 68 includes the valve control unit 74, and a switching control unit 76. The valve control unit 74 and the switching control unit 76 are implemented by the processor executing a program. At least one of the valve control unit 74 and the switching control unit 76 may be implemented by an integrated circuit such as an ASIC, an FPGA, or the like. Further, at least one of the valve control unit 74 and the switching control unit 76 may be constituted by an electronic circuit including a discrete device.

The valve control unit 74 controls the first opening/closing valve 70 and the second opening/closing valve 72, based on the first concentration sensor 62 and the second concentration sensor 64 that are provided at a position more upstream than the merging portion MP. In this case, the valve control unit 74 causes the first opening/closing valve 70 and the second opening/closing valve 72 to open and close, in a manner so that the first concentration and the second concentration become the predetermined concentration ratio. The predetermined concentration ratio is the ratio between the concentration of hydrogen gas and the concentration of the carbon monoxide, and is stored in a storage unit. The predetermined concentration ratio may be input from the operation unit by an operation of the operator, or may be set beforehand as a default value. According to the present embodiment, the concentration ratio between the hydrogen gas and the carbon monoxide is set to a ratio of "3:1". In the hydrocarbon synthesizing device 20, methane is synthesized as the hydrocarbon.

The switching control unit 76 switches and controls the switching device 60, based on the first concentration sensor 62 and the second concentration sensor 64 that are provided at a position more downstream than the merging portion MP. At a time when the electrolysis device 18 is started, the switching control unit 76 switches the connection with the electrolysis device 18 to the separation device 50. In the case that the ratio between the first concentration detected by the first concentration sensor 62 and the second concentration detected by the second concentration sensor 64 lies within the specified concentration range, the switching control unit 76 switches the connection with the electrolysis device 18 to the hydrocarbon synthesizing device 20. After the connection with the electrolysis device 18 is switched to the hydrocarbon synthesizing device 20, and when the ratio between the first concentration and the second concentration becomes outside of the specified concentration range, the switching control unit 76 switches the connection with the electrolysis device 18 to the separation device 50 again.

The specified concentration range is a range ($\pm\alpha$) that is automatically specified on the basis of a predetermined concentration ratio. An upper limit value ($+\alpha$) of the specified concentration range is greater than the predetermined concentration ratio, and the lower limit value ($-\alpha$) of the specified concentration range is smaller than the predetermined concentration ratio.

Figure 2:
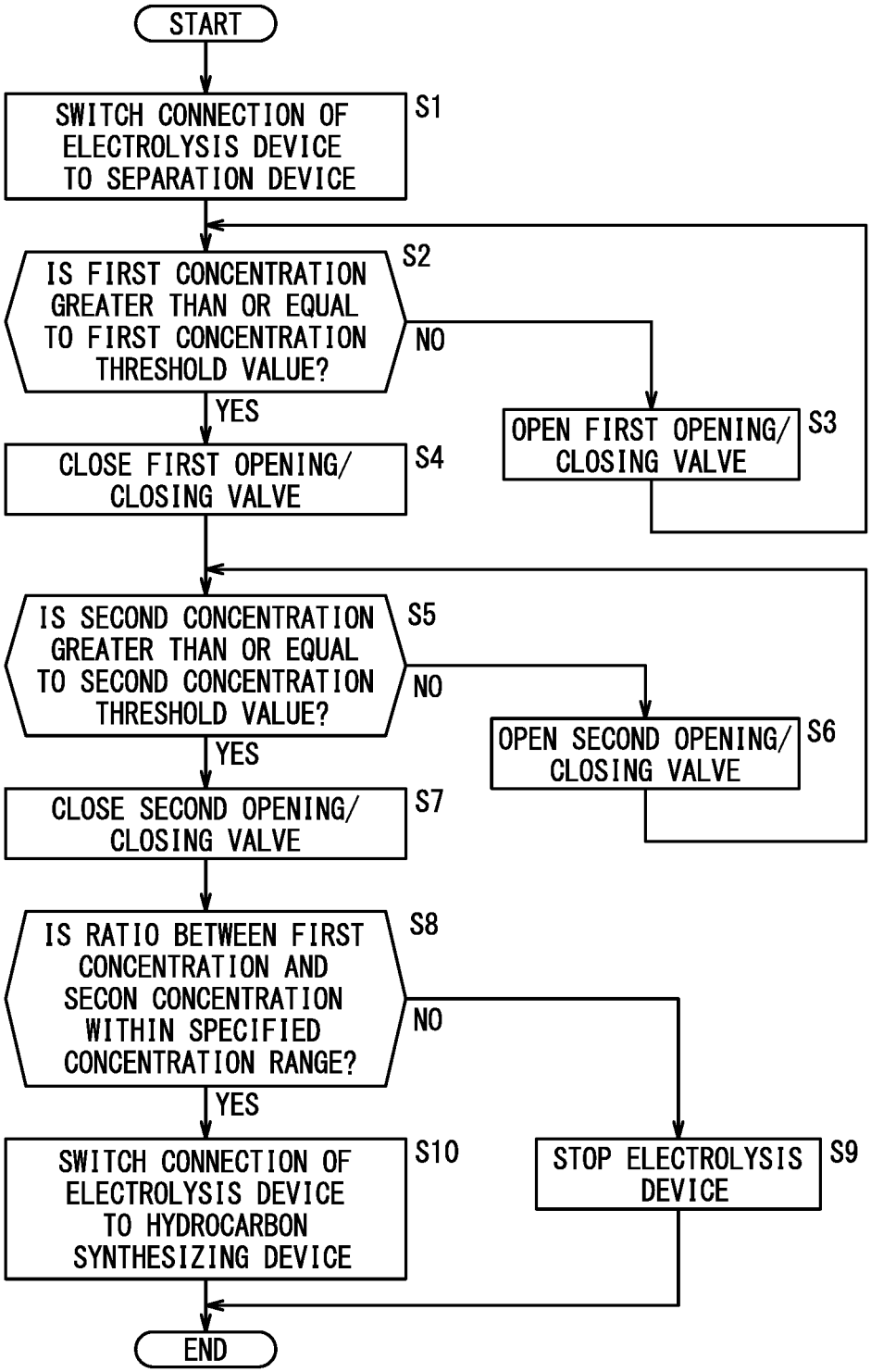
FIG. 2 is a flow chart showing a control processing procedure of the control device.

FIG. 2 is a flow chart showing a control processing procedure of the control device 68. This control process is a process for controlling the switching device 60, the first opening/closing valve 70, and the second opening/closing valve 72. The control process is executed at a time when the electrolysis device 18 is started. Further, the control process is executed in the case that a ratio between the first concentration detected by the first concentration sensor 62 and the second concentration detected by the second concentration sensor 64 changes from lying within the specified concentration range to being outside of the specified concentration range. The description of the control process given below assumes that the first concentration is the concentration of the hydrogen gas, and the second concentration is the concentration of the carbon monoxide gas.

In step S1, the switching control unit 76 controls the switching device 60, and thereby switches the connection of the electrolysis device 18 to the separation device 50. When the connection of the electrolysis device 18 is switched to the separation device 50, the control process transitions to step S2.

In step S2, the valve control unit 74 compares the first concentration detected by the first concentration sensor 62 with the first concentration threshold value. In the case that the first concentration is less than the first concentration threshold value (step S2: NO), the control process transitions to step S3. Conversely, in the case that the first concentration is greater than or equal to the first concentration threshold value (step S2: YES), the control process transitions to step S4.

In step S3, the valve control unit 74 opens the first opening/closing valve 70. However, in the case that the first opening/closing valve 70 has already been opened in step S3, the valve control unit 74 maintains the valve-opened state of the first opening/closing valve 70. When the valve-opened state of the first opening/closing valve 70 is confirmed, the control process returns to step S2.

In step S4, the valve control unit 74 closes the first opening/closing valve 70. However, in the case that the first opening/closing valve 70 has already been closed in step S4, the valve control unit 74 maintains the valve-closed state of the first opening/closing valve 70. When the valve-closed state of the first opening/closing valve 70 is confirmed, the control process transitions to step S5.

In step S5, the valve control unit 74 compares the second concentration detected by the second concentration sensor 64 with the second concentration threshold value. In the case that the second concentration is less than the second concentration threshold value (step S5: NO), the control process transitions to step S6. On the other hand, in the case that the second concentration is greater than or equal to the second concentration threshold value (step S5: YES), the control process transitions to step S7.

In step S6, the valve control unit 74 opens the second opening/closing valve 72. However, in the case that the second opening/closing valve 72 has already been opened in step S6, the valve control unit 74 maintains the valve-opened state of the second opening/closing valve 72. When the valve-opened state of the second opening/closing valve 72 is confirmed, the control process transitions to step S5.

In step S7, the valve control unit 74 closes the second opening/closing valve 72. However, in the case that the second opening/closing valve 72 has already been closed in step S7, the valve control unit 74 maintains the valve-closed state of the second opening/closing valve 72. When the valve-closed state of the second opening/closing valve 72 is confirmed, the control process transitions to step S8.

In step S8, the switching control unit 76 compares the ratio between the first concentration detected by the first concentration sensor 62, and the second concentration detected by the second concentration sensor 64 with the specified concentration range. In the case that the ratio between the first concentration and the second concentration is outside of the specified concentration range (step S8: NO), the switching control unit 76 determines that it will be difficult to adjust the concentrations of the hydrogen gas and the carbon monoxide gas to the predetermined concentration ratio. In this case, the control process transitions to step S9. On the other hand, in the case that the ratio between the first concentration and the second concentration lies within the specified concentration range (step S8: YES), the switching control unit 76 determines that it is possible to adjust the concentrations of the hydrogen gas and the carbon monoxide gas to the predetermined concentration ratio. In this case, the control process transitions to step S10.

In step S9, the control device 68 causes the electrolysis device 18 to stop. In this case, the control device 68 stops applying the voltage to the fuel electrode 47 and the oxygen electrode 48 of each of the electrolytic cells 45, together with stopping the supply of the water vapor and the carbon dioxide gas to the electrolysis device 18. When the electrolysis device 18 is made to stop, the control process is brought to an end.

In step S10, the switching control unit 76 controls the switching device 60, and thereby switches the connection of the electrolysis device 18 to the hydrocarbon synthesizing device 20. When the connection of the electrolysis device 18 is switched to the hydrocarbon synthesizing device 20, the control process is brought to an end.

According to the present embodiment as described above, the flow rate of the hydrogen gas supplied from the hydrogen gas storage device 52 to the generated gas flow path 34, and the flow rate of the carbon monoxide gas supplied from the carbon monoxide gas storage device 56 to the generated gas flow path 34 are adjusted. In this case, on the basis of the detection results of the first concentration sensor 62 and the second concentration sensor 64, the flow rate is adjusted in a manner so that the hydrogen gas and the carbon monoxide gas are supplied at the predetermined concentration ratio to the hydrocarbon synthesizing device 20.

Consequently, according to the present embodiment, the hydrogen gas and the carbon monoxide gas can be supplied to the hydrocarbon synthesizing device 20 at appropriate proportions. Therefore, according to the present embodiment, hydrocarbons can be stably synthesized without waste.

EXEMPLARY MODIFICATIONS

The above-described embodiment may be modified in the following manner.

Exemplary Modification 1

Figure 3:
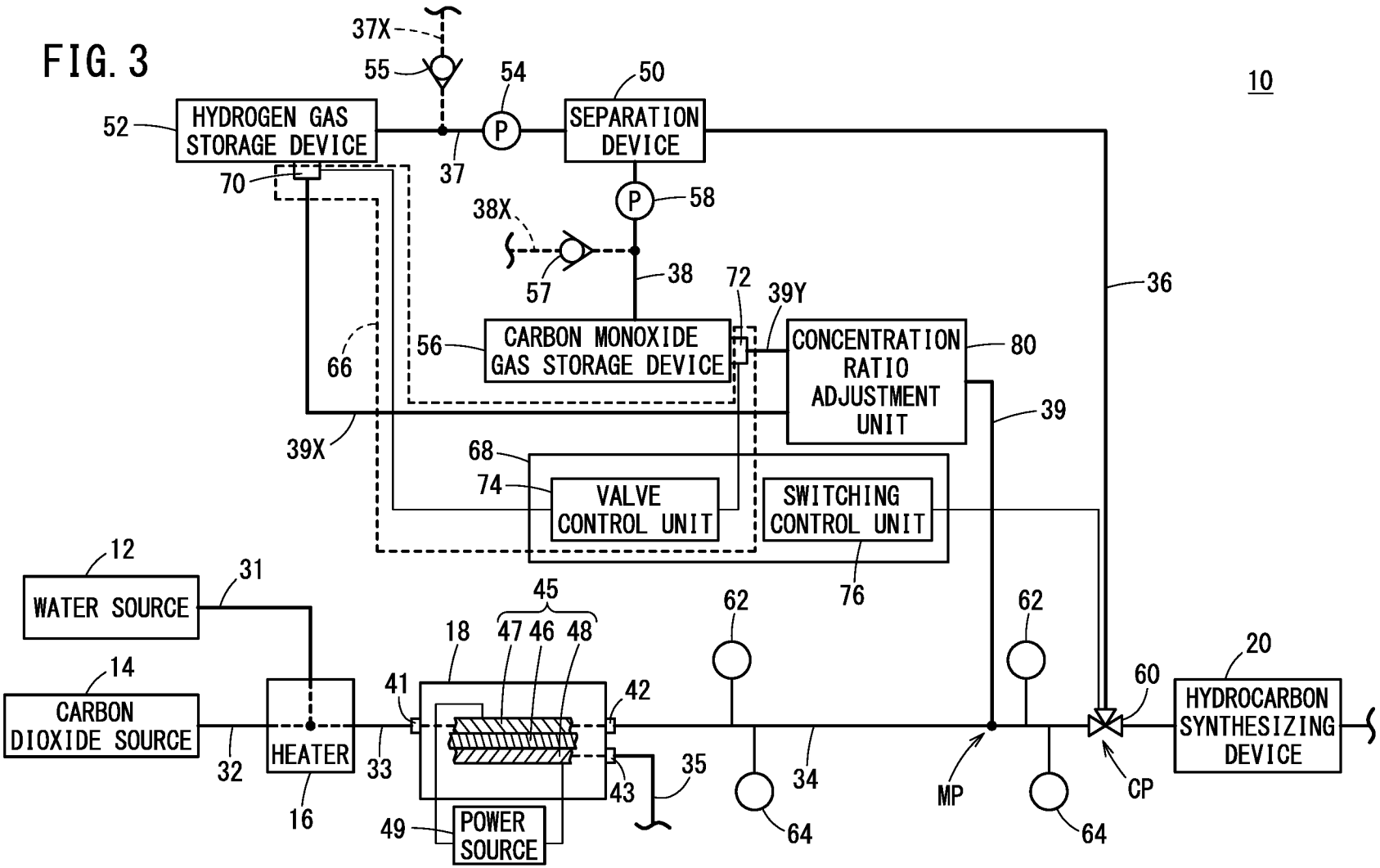
FIG. 3 is a schematic diagram showing the configuration of an electrosynthesis system according to an Exemplary Modification 1.

FIG. 3 is a schematic diagram showing the configuration of the electrosynthesis system 10 according to an Exemplary Modification 1. In FIG. 3, the same reference numerals are assigned to the same constituent elements as those described in the embodiment. Moreover, according to the present exemplary modification, descriptions which overlap or are duplicative with those of the embodiment will be omitted. In the electrosynthesis system 10 according to the Exemplary Modification 1, a concentration ratio adjustment unit 80 is additionally provided.

The concentration ratio adjustment unit 80 is connected to the hydrogen gas storage device 52 via the hydrogen gas flow path 39X. Further, the concentration ratio adjustment unit 80 is connected to the carbon monoxide gas storage device 56 via the carbon monoxide gas flow path 39Y. Furthermore, the concentration ratio adjustment unit 80 is connected via the merging flow path 39 to the generated gas flow path 34.

The concentration ratio adjustment unit 80 mixes at the predetermined concentration ratio the hydrogen gas supplied from the hydrogen gas storage device 52, and the carbon monoxide gas supplied from the carbon monoxide gas storage device 56. For example, the concentration ratio adjustment unit 80 includes a first orifice plate provided in the hydrogen gas flow path 39X, and a second orifice plate provided in the carbon monoxide gas flow path 39Y. The ratio between the flow rate adjusted by the first orifice plate, and the flow rate adjusted by the second orifice plate coincides with the predetermined concentration ratio (the ratio between the concentration of the hydrogen gas and the concentration of the carbon monoxide). For example, in the case that the ratio between the concentration of the hydrogen gas and the concentration of the carbon monoxide gas is a ratio of "3:1", the ratio between the flow rate adjusted by the first orifice plate and the flow rate adjusted by the second orifice plate is a ratio of "3:1". The hydrogen gas and the carbon monoxide gas that are mixed are supplied to the generated gas flow path 34 via the merging flow path 39.

In this manner, according to the present exemplary modification, by providing the concentration ratio adjustment unit 80, which mixes the hydrogen gas and the carbon monoxide gas at the predetermined concentration ratio, the concentration ratio between the hydrogen gas and the carbon monoxide gas can be adjusted accurately and quickly.

Exemplary Modification 2

Figure 4:
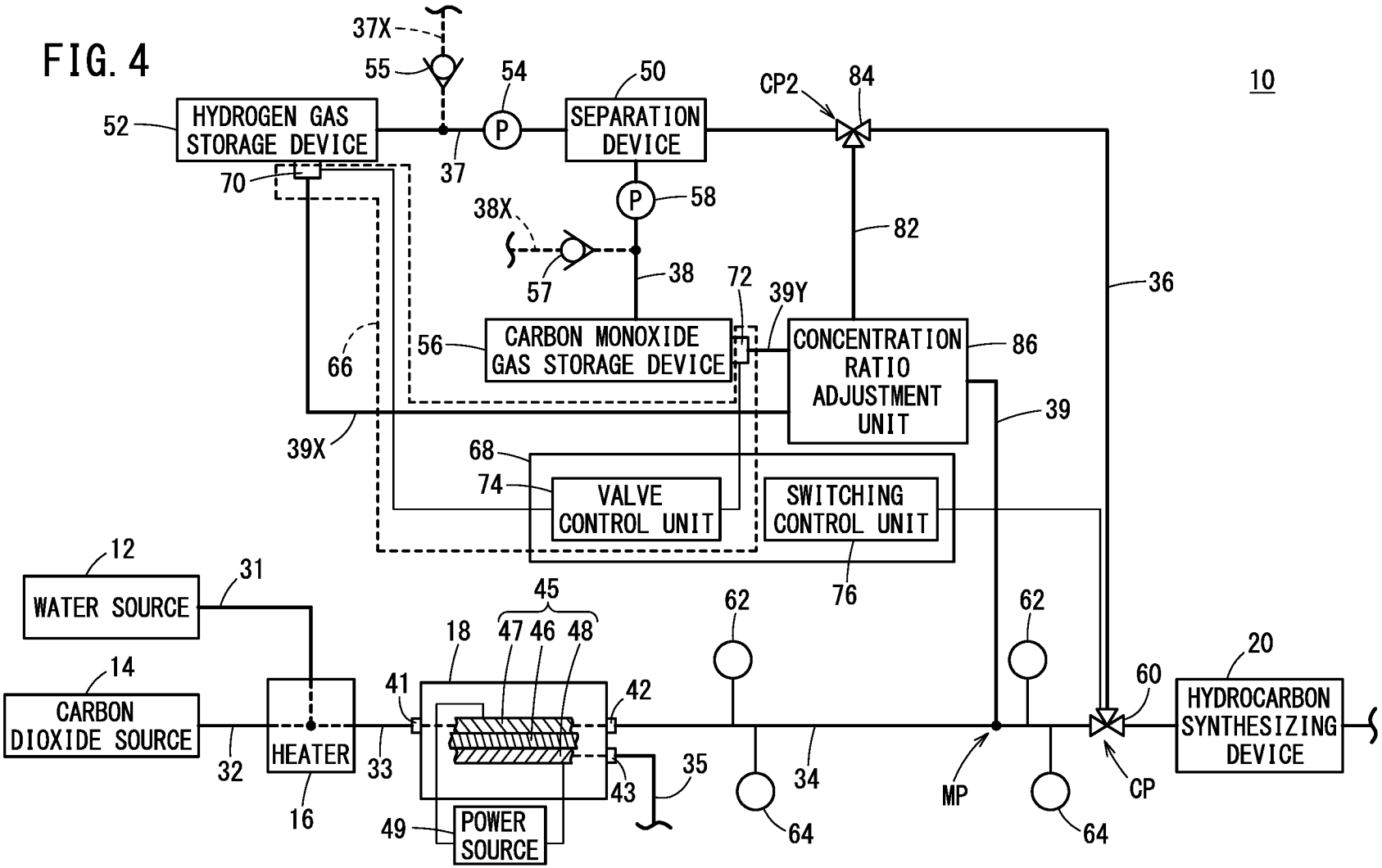
FIG. 4 is a schematic diagram showing the configuration of an electrosynthesis system according to an Exemplary Modification 2.

FIG. 4 is a schematic diagram showing the configuration of the electrosynthesis system 10 according to an Exemplary Modification 2. In FIG. 4, the same reference numerals are assigned to the same constituent elements as those described in the embodiment. Moreover, according to the present exemplary modification, descriptions which overlap or are duplicative with those of the embodiment will be omitted. In the electrosynthesis system 10 according to the Exemplary Modification 2, a second branching flow path 82, a second switching device 84, and a concentration ratio adjustment unit 86 are additionally provided.

The second branching flow path 82 branches off from the branching flow path 36, and is connected to the concentration ratio adjustment unit 86. The second switching device 84 switches the supply destination of the gas supplied from the generated gas flow path 34 to either one of the separation device 50 or the concentration ratio adjustment unit 86.

The second switching device 84 may be a three-way valve or a pair of opening/closing valves. In FIG. 4, an example is shown in which the second switching device 84 is a three-way valve. In the case that the second switching device 84 is a three-way valve, the three-way valve is provided at a connecting portion CP2 between the branching flow path 36 and the second branching flow path 82. In the case that the second switching device 84 is a pair of opening/closing valves, one of the pair of opening/closing valves is provided in the branching flow path 36 between the connecting portion CP2 and the separation device 50. Further, the other one of the pair of opening/closing valves is provided in the second branching flow path 82 between the connecting portion CP2 and the concentration ratio adjustment unit 86.

A switching control of the second switching device 84 is executed by the switching control unit 76. For example, in the case that a storage device internal pressure, which is detected by the pressure sensor provided in the hydrogen gas storage device 52, is greater than or equal to a predetermined pressure threshold value, the switching control unit 76 switches the supply destination of the gas supplied from the generated gas flow path 34 to the concentration ratio adjustment unit 86. On the other hand, in the case that the storage device internal pressure is less than the predetermined pressure threshold value, the switching control unit 76 switches the supply destination of the gas supplied from the generated gas flow path 34 to the separation device 50.

The concentration ratio adjustment unit 86 mixes the hydrogen gas supplied from the hydrogen gas storage device 52 and the carbon monoxide gas supplied from the carbon monoxide gas storage device 56 with the hydrogen gas and the carbon monoxide gas supplied via the second branching flow path 82. In this case, the concentration ratio adjustment unit 86 adjusts the mixed amount of the hydrogen gas supplied from the hydrogen gas storage device 52 and the mixed amount of the carbon monoxide gas supplied from the carbon monoxide gas storage device 56. Specifically, the concentration ratio adjustment unit 86 adjusts the mixed amount, in a manner so that the first concentration detected by the first second sensor 62, and the second concentration detected by the second concentration sensor 64 become the predetermined concentration ratio.

In this manner, according to the present exemplary modification, by providing the concentration ratio adjustment unit 86, which mixes the hydrogen gas and the carbon monoxide gas at the predetermined concentration ratio, the concentration ratio between the hydrogen gas and the carbon monoxide gas can be adjusted accurately and quickly.

Moreover, it should be noted that, according to the present exemplary modification, the second switching device 84 may be removed. In the case that the second switching device 84 is removed, in the same manner as in the embodiment, the switching control unit 76 controls only the switching device 60.

Exemplary Modification 3

Figure 5:
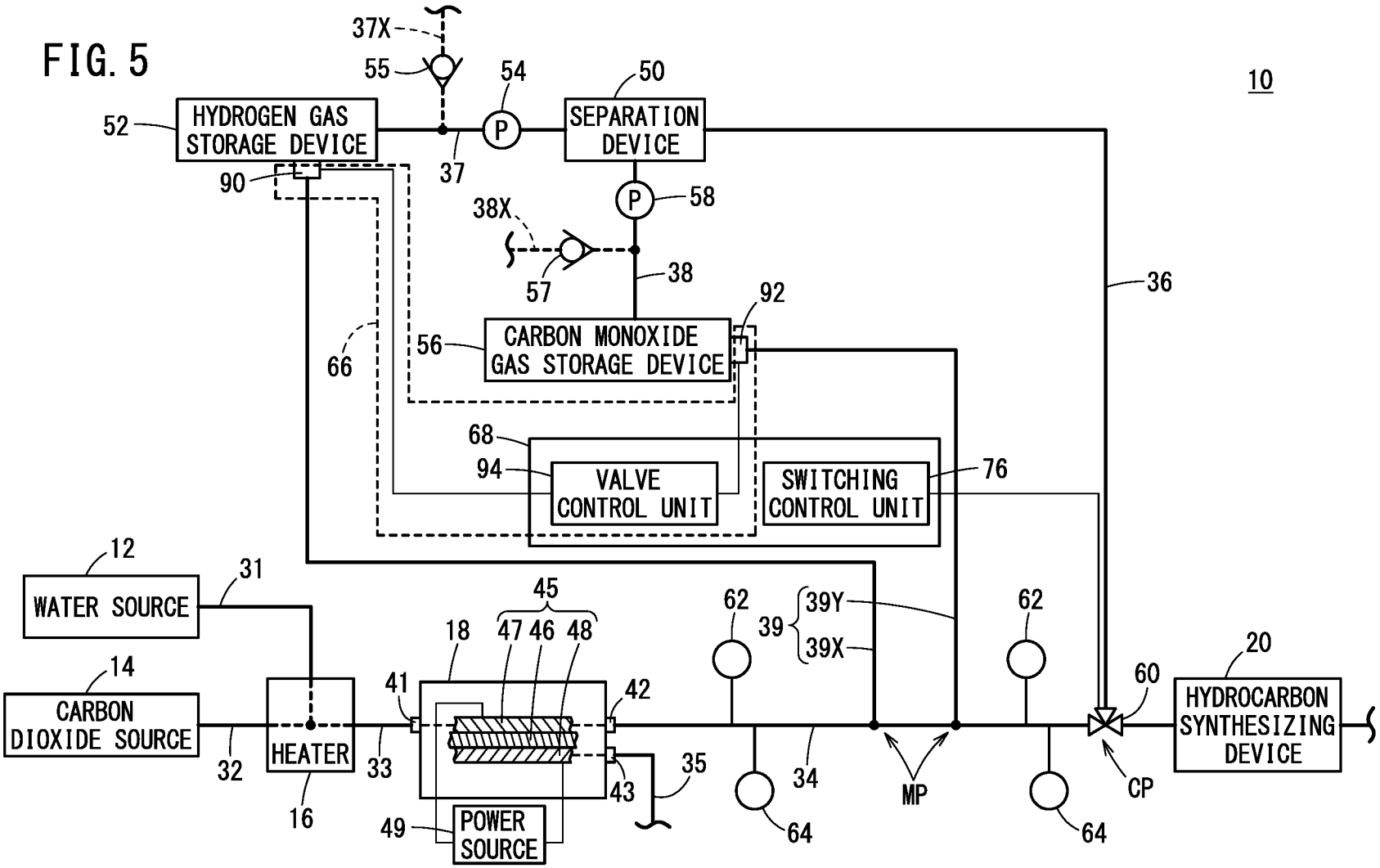
FIG. 5 is a schematic diagram showing the configuration of an electrosynthesis system according to an Exemplary Modification 3.

FIG. 5 is a schematic diagram showing the configuration of the electrosynthesis system 10 according to an Exemplary Modification 3. In FIG. 5, the same reference numerals are assigned to the same constituent elements as those described in the embodiment. Moreover, according to the present exemplary modification, descriptions which overlap or are duplicative with those of the embodiment will be omitted. In the electrosynthesis system 10 according to the Exemplary Modification 3, the first opening/closing valve 70 is replaced with a first flow rate adjustment valve 90, the second opening/closing valve 72 is replaced with a second flow rate adjustment valve 92, and the valve control unit 74 is replaced with a valve control unit 94.

The first flow rate adjustment valve 90 is provided at the outlet portion of the hydrogen gas storage device 52. The first flow rate adjustment valve 90 includes a valve main body part that is capable of adjusting the flow rate of the hydrogen gas flow path 39X. By the degree of opening of the first flow rate adjustment valve 90 being controlled, the flow rate of the hydrogen gas supplied from the hydrogen gas storage device 52 to the generated gas flow path 34 is adjusted.

The second flow rate adjustment valve 92 is provided at the outlet portion of the carbon monoxide gas storage device 56. The second flow rate adjustment valve 92 includes a valve main body part that is capable of adjusting the flow rate of the carbon monoxide gas flow path 39Y. By the degree of opening of the second flow rate adjustment valve 92 being controlled, the flow rate of the carbon monoxide gas supplied from the carbon monoxide gas storage device 56 to the generated gas flow path 34 is adjusted.

The valve control unit 94 controls the first flow rate adjustment valve 90 and the second flow rate adjustment valve 92, and thereby adjusts the degree of opening of the first flow rate adjustment valve 90 and the degree of opening of the second flow rate adjustment valve 92. The adjustment of these degrees of opening includes a case in which the degrees of opening are zero.

In the case that the degree of opening of the first flow rate adjustment valve 90 is zero, the flow rate of the hydrogen gas supplied from the hydrogen gas storage device 52 to the generated gas flow path 34 is zero. As the degree of opening of the first flow rate adjustment valve 90 becomes larger, the flow rate of the hydrogen gas supplied from the hydrogen gas storage device 52 to the generated gas flow path 34 becomes greater. Similarly, in the case that the degree of opening of the second flow rate adjustment valve 92 is zero, the flow rate of the carbon monoxide gas supplied from the carbon monoxide gas storage device 56 to the generated gas flow path 34 is zero. As the degree of opening of the second flow rate adjustment valve 92 becomes larger, the flow rate of the carbon monoxide gas supplied from the carbon monoxide gas storage device 56 to the generated gas flow path 34 becomes greater.

The valve control unit 94 controls the degree of opening of the first flow rate adjustment valve 90 and the degree of opening of the second flow rate adjustment valve 92, based on the first concentration sensor 62 and the second concentration sensor 64 that are provided at a position more upstream than the merging portion MP. In this case, the valve control unit 94 adjusts the degree of opening of the first flow rate adjustment valve 90 and the degree of opening of the second flow rate adjustment valve 92, in a manner so that the first concentration and the second concentration become the predetermined concentration ratio.

In this manner, according to the present exemplary modification, by adjusting the output amount (the flow rate of the hydrogen gas) from the hydrogen gas storage device 52 and the output amount (the flow rate of the carbon monoxide gas) from the carbon monoxide gas storage device 56, the concentration ratio between the hydrogen gas and the carbon monoxide gas can be adjusted accurately and quickly.

Exemplary Modification 4

Figure 6:
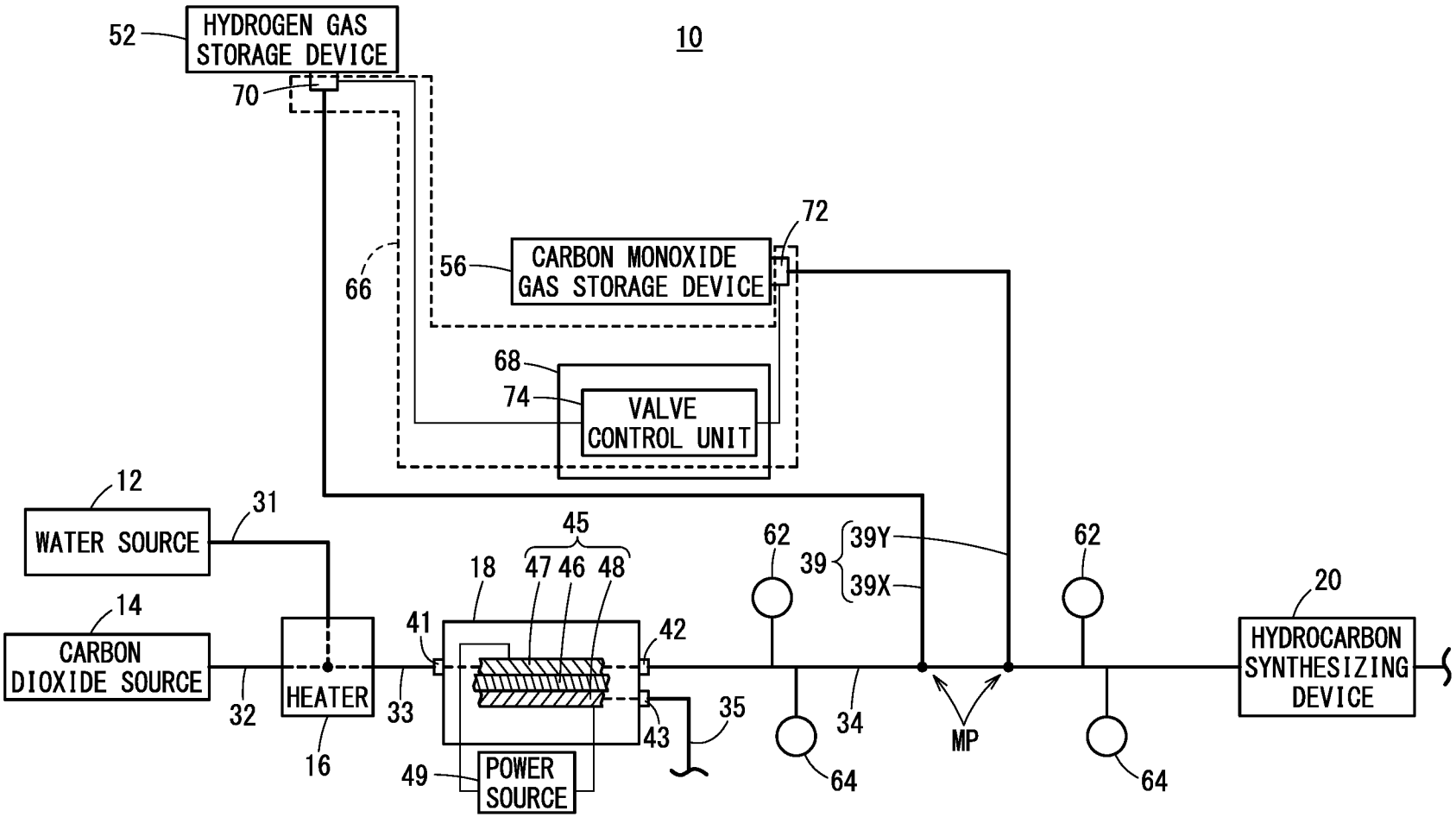
FIG. 6 is a schematic diagram showing the configuration of an electrosynthesis system according to an Exemplary Modification 4.

FIG. 6 is a schematic diagram showing the configuration of the electrosynthesis system 10 according to an Exemplary Modification 4. In FIG. 6, the same reference numerals are assigned to the same constituent elements as those described in the embodiment. Moreover, according to the present exemplary modification, descriptions which overlap or are duplicative with those of the embodiment will be omitted. In the electrosynthesis system 10 according to the Exemplary Modification 4, the hydrogen gas flow path 37, the purge flow path 37X, the check valve 55, the first pump 54, the carbon monoxide gas flow path 38, the purge flow path 38X, the check valve 57, the second pump 58, the branching flow path 36, the separation device 50, the switching device 60, and the switching control unit 76 are removed.

Even in the case that each of the above-described components are removed, the same advantageous effects as those of the embodiment can be obtained.

Moreover, according to the present exemplary modification, the hydrogen gas storage device 52 and the carbon monoxide gas storage device 56 are provided in an interchangeable manner. The hydrogen gas storage device 52 may include a plug to which there is connected a hydrogen gas replenishing device for replenishing the hydrogen gas. Similarly, the carbon monoxide gas storage device 56 may include a plug to which there is connected a carbon monoxide gas replenishing device for replenishing the carbon monoxide gas.

Further, according to the present exemplary modification, in the case that the amount of the stored gas has become less than a predetermined amount, the control device 68 may issue a notification that the hydrogen gas or the carbon monoxide gas should be replenished. For example, in the case that the storage device internal pressure detected by the pressure sensor (the first pressure sensor) provided in the hydrogen gas storage device 52 has fallen below a predetermined first pressure lower limit value, the control device 68 displays a message on the display unit that the hydrogen gas should be replenished. Similarly, in the case that the storage device internal pressure detected by the pressure sensor (the second pressure sensor) provided in the carbon monoxide gas storage device 56 has fallen below a predetermined second pressure lower limit value, the control device 68 displays a message on the display unit that the carbon monoxide gas should be replenished.

Exemplary Modification 5

Figure 7:
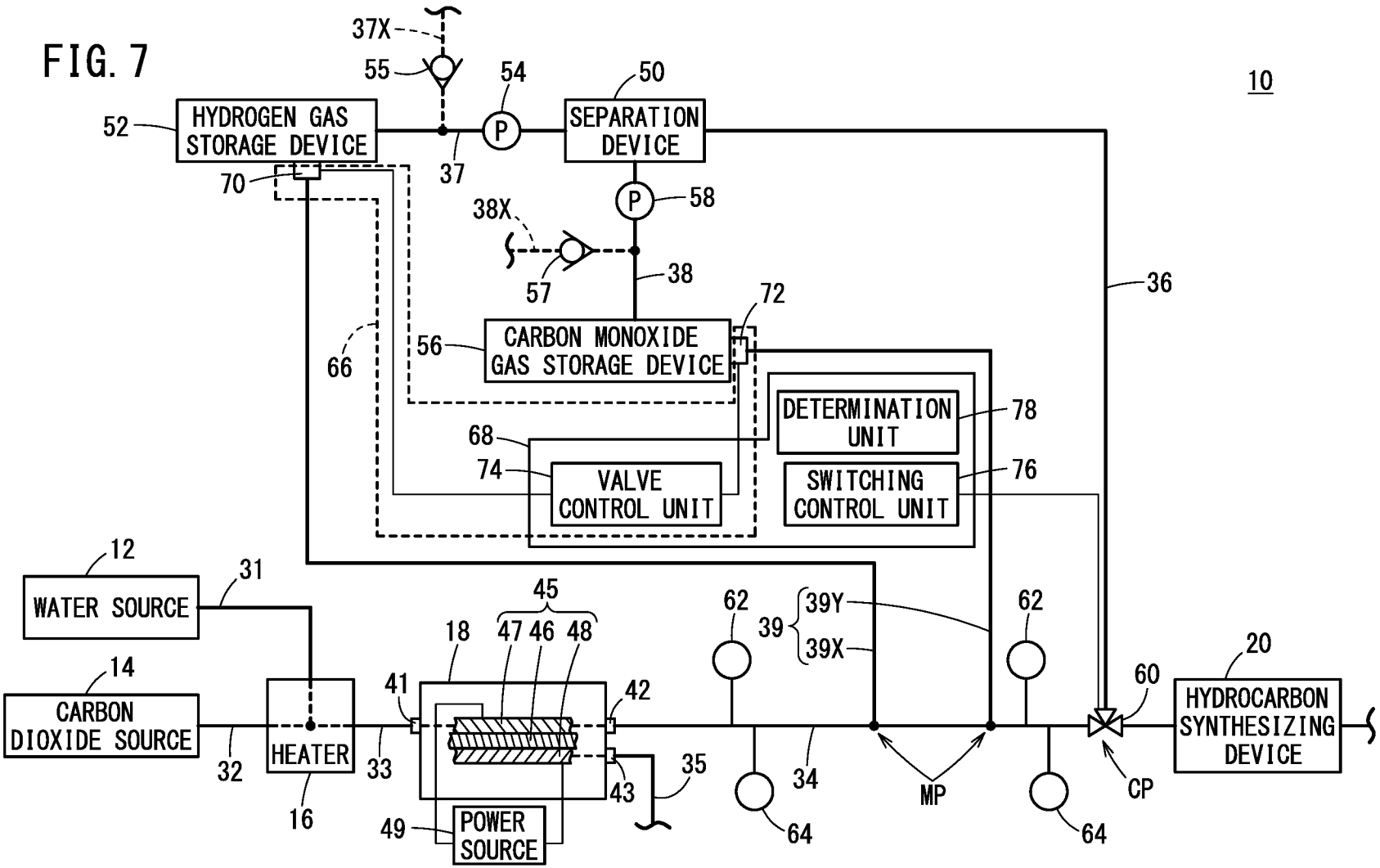
FIG. 7 is a schematic diagram showing the configuration of an electrosynthesis system according to an Exemplary Modification 5.

FIG. 7 is a schematic diagram showing the configuration of the electrosynthesis system 10 according to an Exemplary Modification 5. In FIG. 7, the same reference numerals are assigned to the same constituent elements as those described in the embodiment. Moreover, according to the present exemplary modification, descriptions which overlap or are duplicative with those of the embodiment will be omitted.

According to the present exemplary modification, the first concentration sensor 62, which is provided at a position more upstream than the merging portion MP, is referred to as an upstream first sensor 62. On the other hand, the first concentration sensor 62, which is provided at a position more downstream than the merging portion MP, is referred to as a downstream first sensor 62. Further, the second concentration sensor 64, which is provided at a position more upstream than the merging portion MP, is referred to as an upstream second sensor 64. On the other hand, the second concentration sensor 64, which is provided at a position more downstream than the merging portion MP, is referred to as a downstream second sensor 64.

In the electrosynthesis system 10 according to the Exemplary Modification 5, a determination unit 78 is additionally provided. The determination unit 78 determines a sensor failure, on the basis of a detection result of the upstream first sensor 62, and a detection result of the downstream first sensor 62.

The determination unit 78 calculates, at each of predetermined intervals, a first absolute value difference and a second absolute value difference. The first absolute value difference is an absolute value of a value obtained by subtracting the first concentration detected by the downstream first sensor 62 from the first concentration detected by the upstream first sensor 62. The second absolute value difference is an absolute value of a value obtained by subtracting the second concentration detected by the downstream second sensor 64 from the second concentration detected by the upstream second sensor 64.

In the case that the first absolute value difference is greater than or equal to the predetermined first threshold value, the determination unit 78 determines that there is a failure in either one of the upstream first sensor 62 or the downstream first sensor 62. In the case that the second absolute value difference is greater than or equal to the predetermined second threshold value, the determination unit 78 determines that there is a failure in either one of the upstream second sensor 64 or the downstream second sensor 64.

Consequently, according to the present exemplary modification, it is possible to suppress any variance caused by a sensor failure in the concentration ratio between the hydrogen gas and the carbon monoxide gas that are supplied to the hydrocarbon synthesizing device 20.

Exemplary Modification 6

Figure 8:
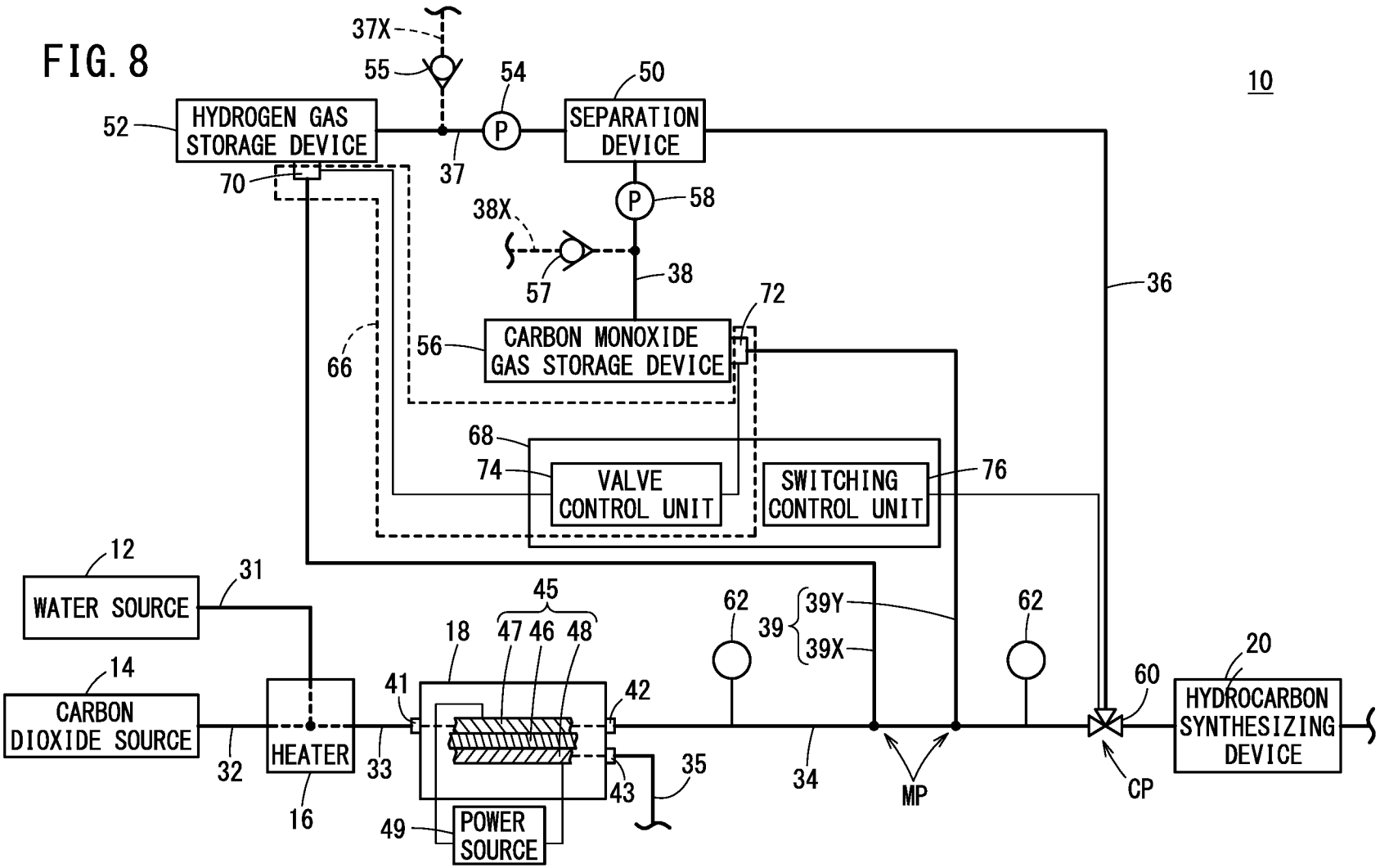
FIG. 8 is a schematic diagram showing the configuration of an electrosynthesis system according to an Exemplary Modification 6.

FIG. 8 is a schematic diagram showing the configuration of the electrosynthesis system 10 according to an Exemplary Modification 6. In FIG. 8, the same reference numerals are assigned to the same constituent elements as those described in the embodiment. Moreover, according to the present exemplary modification, descriptions which overlap or are duplicative with those of the embodiment will be omitted. In the electrosynthesis system 10 according to the Exemplary Modification 6, the second concentration sensor 64 is removed.

According to the present exemplary modification, the second concentration is calculated. Specifically, the second concentration is obtained by subtracting the first concentration from the total. Accordingly, even in the case that the second concentration sensor 64 is removed, the same advantageous effects as in the embodiment can be obtained. The present exemplary modification can also be applied to any one of the Exemplary Modification 1 to the Exemplary Modification 5.

Exemplary Modification 7

Figure 9:
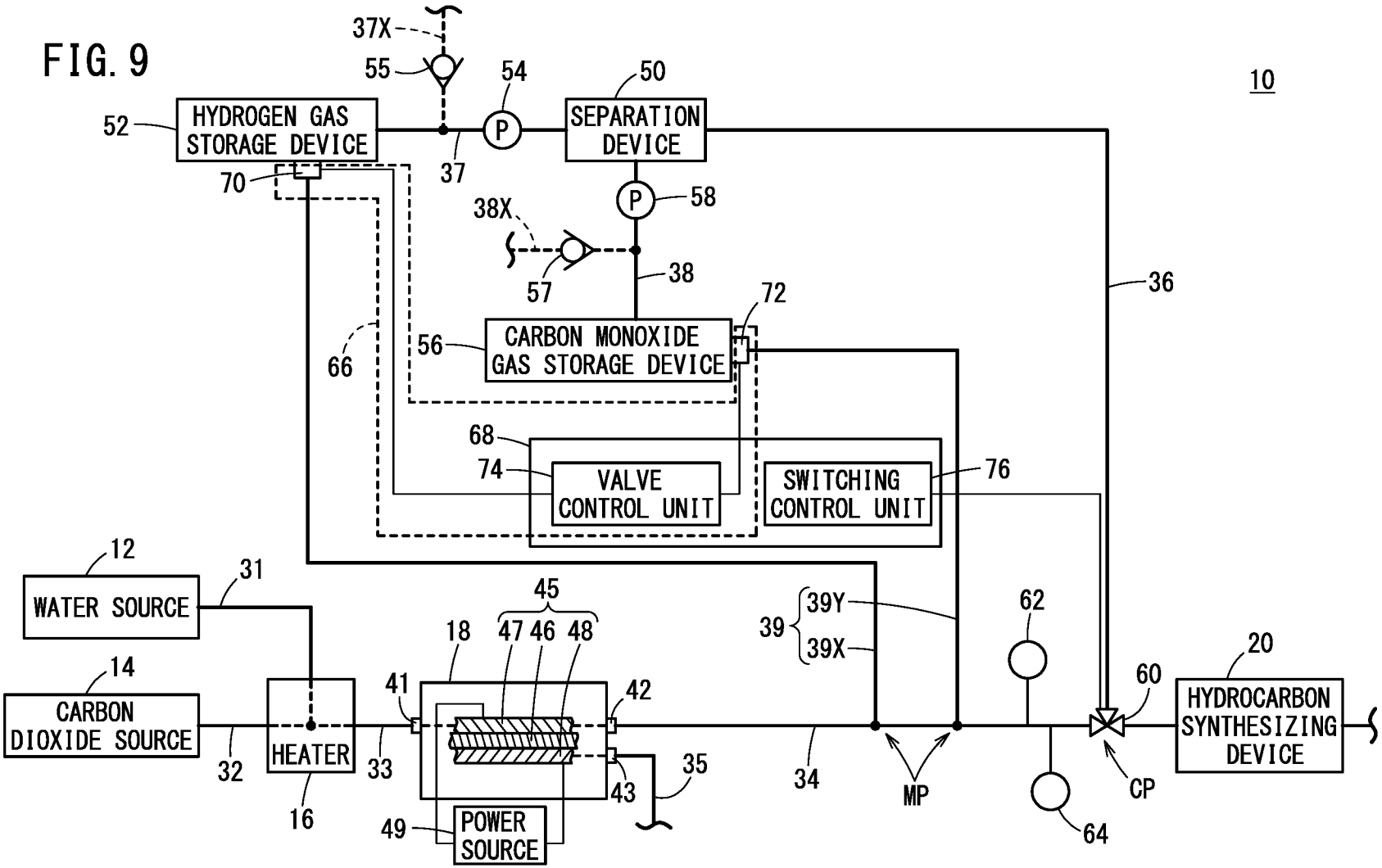
FIG. 9 is a schematic diagram showing the configuration of an electrosynthesis system according to an Exemplary Modification 7.

FIG. 9 is a schematic diagram showing the configuration of the electrosynthesis system 10 according to an Exemplary Modification 7. In FIG. 9, the same reference numerals are assigned to the same constituent elements as those described in the embodiment. Moreover, according to the present exemplary modification, descriptions which overlap or are duplicative with those of the embodiment will be omitted. In the electrosynthesis system 10 according to the Exemplary Modification 7, the first concentration sensor 62 and the second concentration sensor 64, which are provided at a position more upstream than the merging portion MP, are removed.

According to the present exemplary modification, the control of the first opening/closing valve 70 and the second opening/closing valve 72 by the valve control unit 74 is carried out on the basis of the first concentration sensor 62 and the second concentration sensor 64 that are provided at a position more downstream than the merging portion MP. Accordingly, even in the case that the first concentration sensor 62 and the second concentration sensor 64, which are provided at a position more upstream than the merging portion MP, are removed, the same advantageous effects as in the embodiment can be obtained. The present exemplary modification can also be applied to any one of the Exemplary Modification 1 to the Exemplary Modification 4, and to the Exemplary Modification 6. Moreover, in the case that the present exemplary modification is applied to the Exemplary Modification 3, by the valve control unit 94, the adjustment of the degree of opening of the first flow rate adjustment valve 90 and the degree of opening of the second flow rate adjustment valve 92 can be carried out on the basis of the first concentration sensor 62 and the second concentration sensor 64 that are provided at a position more downstream than the merging portion MP.

Exemplary Modification 8

In a state in which the electrolysis device 18 and the hydrocarbon synthesizing device 20 are connected, in the case that the storage device internal pressure of the hydrogen gas storage device 52 has fallen below the predetermined first pressure lower limit value, the control device 68 may switch the connection with the electrolysis device 18 to the separation device 50. Similarly, in a state in which the electrolysis device 18 and the hydrocarbon synthesizing device 20 are connected, in the case that the storage device internal pressure of the carbon monoxide gas storage device 56 has fallen below the predetermined second pressure lower limit value, the control device 68 may switch the connection with the electrolysis device 18 to the separation device 50.

Exemplary Modification 9

In the embodiment, the specified concentration range is set to the ratio between the concentration of the hydrogen gas and the concentration of the carbon monoxide gas. However, the specified concentration range may be set to either one of the concentration of the hydrogen gas or the concentration of the carbon monoxide gas. In the case that the specified concentration range is set to the concentration of the hydrogen gas, the concentration of the hydrogen gas (the first concentration or the second concentration) detected by the first concentration sensor 62 or the second concentration sensor 64 is compared with the specified concentration range. On the other hand, in the case that the specified concentration range is set to the concentration of the carbon monoxide gas, the concentration of the carbon monoxide gas (the first concentration or the second concentration) detected by the first concentration sensor 62 or the second concentration sensor 64 is compared with the specified concentration range.

Exemplary Modification 10

In the embodiment, the concentration ratio (the predetermined concentration ratio) between the hydrogen gas and the carbon monoxide is set to a ratio of "3:1". According to the present invention, the predetermined concentration ratio is not limited to being a ratio of "3:1". For example, the predetermined concentration ratio can be set to a ratio of "2:1". In this case, in the hydrocarbon synthesizing device 20, methanol is synthesized as the hydrocarbon. The chemical reaction formula is "$CO+2H_2 \rightarrow CH_3OH$".

Exemplary Modification 11

The embodiment and the Exemplary Modification 1 to the Exemplary Modification 10 may be arbitrarily combined within a range in which the combinations do not deviate from the object of the present invention.

Invention

The invention and the advantageous effects that are capable of being grasped from the above description will be described below.

(1) The present invention is characterized by the electrosynthesis system (10) comprising the electrolysis device (18) that performs electrolysis on the raw material gas containing carbon dioxide gas and water vapor, and thereby generates the generated gas containing hydrogen gas and carbon monoxide gas, the hydrocarbon synthesizing device (20) that synthesizes hydrocarbons based on the generated gas, and the generated gas flow path (34) which is connected to the electrolysis device and the hydrocarbon synthesizing device, the electrosynthesis system further comprising the hydrogen gas storage device (52) that is capable of storing the hydrogen gas, the carbon monoxide gas storage device (56) that is capable of storing the carbon monoxide gas, the first concentration sensor (62) that detects the first concentration, which is the concentration of one of the hydrogen gas and the carbon monoxide gas flowing through the generated gas flow path, and the adjustment device (66) that adjusts the flow rate of the hydrogen gas supplied from the hydrogen gas storage device to the generated gas flow path, and the flow rate of the carbon monoxide gas supplied from the carbon monoxide gas storage device to the generated gas flow path, based on the detection result of the first concentration sensor, in a manner so that the hydrogen gas and the carbon monoxide gas are supplied to the hydrocarbon synthesizing device at the predetermined concentration ratio.

In accordance with such features, the hydrogen gas and the carbon monoxide gas can be supplied to the hydrocarbon synthesizing device at appropriate proportions. Accordingly, hydrocarbons can be stably synthesized without waste. As a result, it is possible to suppress a decrease in the efficiency of the synthesis of hydrocarbons. Further, an exhaust gas containing carbon dioxide gas can be converted into a valuable product with high efficiency. This in turn contributes to a significant reduction in the generation of waste.

(2) The present invention is characterized by the electrosynthesis system, and may further comprise the branching flow path (36) that branches off from the generated gas flow path, the separation device (50) connected to the branching flow path, and that separates the hydrogen gas and the carbon monoxide gas from the generated gas that is supplied via the branching flow path, and the switching device (60) that switches the connection with the electrolysis device to either one of the hydrocarbon synthesizing device or the separation device, wherein the hydrogen gas storage device may store the hydrogen gas that is separated by the separation device, and the carbon monoxide gas storage device may store the carbon monoxide gas that is separated by the separation device. In accordance with such features, the hydrogen gas obtained by the electrolysis of the electrolysis device can be stored in the hydrogen gas storage device. Further, the carbon monoxide gas obtained by the electrolysis of the electrolysis device can be stored in the carbon monoxide gas storage device. Accordingly, the hydrogen gas and the carbon monoxide gas can be used efficiently.

(3) The present invention is characterized by the electrosynthesis system, and may further comprise the merging flow path (39) connected to the generated gas flow path and that causes the hydrogen gas and the carbon monoxide gas, the flow rates of which have been adjusted by the adjustment device, to merge in a common flow in the generated gas flow path, and the switching control unit (76) that switches and controls the switching device based on the first concentration sensor, wherein the first concentration sensor may be provided in the generated gas flow path at a position more downstream than the merging portion (MP) where the merging flow path merges with the generated gas flow path. In accordance with such features, the hydrogen gas and the carbon monoxide gas, which have been adjusted to the predetermined concentration ratio, can be reliably supplied to the hydrocarbon synthesizing device.

(4) The present invention is characterized by the electrosynthesis system, wherein a plurality of the first concentration sensors may be provided, at least one of the plurality of the first concentration sensors may be provided in the generated gas flow path at a position more upstream than the merging portion, and the adjustment device may adjust the flow rate of the hydrogen gas and the flow rate of the carbon monoxide gas based on the first concentration sensor provided in the generated gas flow path at a position more upstream than the merging portion. In accordance with such features, the ratio between the concentration of the hydrogen gas and the concentration of the carbon monoxide gas supplied to the hydrocarbon synthesizing device can be accurately adjusted so as to become the predetermined concentration ratio.

(5) The present invention is characterized by the electrosynthesis system, and may further comprise the determination unit (78) that determines the presence or absence of a sensor failure, based on the detection result of the first concentration sensor and the detection result of another of the first concentration sensors. In accordance with this feature, it is possible to suppress any variance caused by a sensor failure in the ratio between the concentration of the hydrogen gas and the concentration of the carbon monoxide gas that are supplied to the hydrocarbon synthesizing device.

(6) The present invention is characterized by the electrosynthesis system, and may further comprise the second concentration sensor (64) that detects the second concentration, which is the concentration of the other of the hydrogen gas and the carbon monoxide gas flowing through the generated gas flow path, wherein the adjustment device may adjust the flow rate of the hydrogen gas and the flow rate of the carbon monoxide gas based on the first concentration sensor and the second concentration sensor. In accordance with such features, the ratio between the concentration of the hydrogen gas and the concentration of the carbon monoxide gas supplied to the hydrocarbon synthesizing device can be accurately adjusted so as to become the predetermined concentration ratio.

(7) The present invention is characterized by the electrosynthesis system, and may further comprise the merging flow path connected to the generated gas flow path and that causes the hydrogen gas and the carbon monoxide gas, the flow rates of which have been adjusted by the adjustment device, to merge in a common flow in the generated gas flow path, and the switching control unit that switches and controls the switching device based on the first concentration sensor and the second concentration sensor, wherein the first concentration sensor and the second concentration sensor may be provided in the generated gas flow path at a position more downstream than the merging portion where the merging flow path merges with the generated gas flow path. In accordance with such features, the hydrogen gas and the carbon monoxide gas, which have been adjusted to the predetermined concentration ratio, can be reliably supplied to the hydrocarbon synthesizing device.

Moreover, the present invention is not limited to the above-described disclosure, and various configurations can be adopted therein without departing from the essence and gist of the present invention.

The invention claimed is:

1. An electrosynthesis system comprising an electrolysis device configured to perform electrolysis on a raw material gas containing carbon dioxide gas and water vapor, and thereby generate a generated gas containing hydrogen gas and carbon monoxide gas, a hydrocarbon synthesizing device configured to synthesize hydrocarbons based on the generated gas, and a generated gas flow path connected to the electrolysis device and the hydrocarbon synthesizing device, the electrosynthesis system further comprising:

a hydrogen gas storage device configured to be capable of storing the hydrogen gas;

a carbon monoxide gas storage device configured to be capable of storing the carbon monoxide gas;

a first concentration sensor configured to detect a first concentration, which is a concentration of one of the hydrogen gas and the carbon monoxide gas flowing through the generated gas flow path;

an adjustment device configured to adjust a flow rate of the hydrogen gas supplied from the hydrogen gas storage device to the generated gas flow path, and a flow rate of the carbon monoxide gas supplied from the carbon monoxide gas storage device to the generated gas flow path, based on a detection result of the first concentration sensor, in a manner so that the hydrogen gas and the carbon monoxide gas are supplied to the hydrocarbon synthesizing device at a predetermined concentration ratio;

a branching flow path configured to branch off from the generated gas flow path;

a separation device connected to the branching flow path, and configured to separate the hydrogen gas and the carbon monoxide gas from the generated gas that is supplied via the branching flow path;

a switching device configured to switch the connection with the electrolysis device to either one of the hydrocarbon synthesizing device or the separation device;

a merging flow path connected to the generated gas flow path and configured to cause the hydrogen gas and the carbon monoxide gas, the flow rates of which have been adjusted by the adjustment device, to merge in a common flow in the generated gas flow path; and a switching control unit configured to switch and control the switching device based on the first concentration sensor;

wherein the hydrogen gas storage device stores the hydrogen gas that is separated by the separation device, the carbon monoxide gas storage device stores the carbon monoxide gas that is separated by the separation device, and the first concentration sensor is provided in the generated gas flow path at a position more downstream than a merging portion where the merging flow path merges with the generated gas flow path.

2. The electrosynthesis system according to claim 1, wherein:

a plurality of the first concentration sensors are provided;

at least one of the plurality of the first concentration sensors is provided in the generated gas flow path at a position more upstream than the merging portion; and the adjustment device adjusts the flow rate of the hydrogen gas and the flow rate of the carbon monoxide gas based on the first concentration sensor provided in the generated gas flow path at the position more upstream than the merging portion.

3. The electrosynthesis system according to claim 2, further comprising a determination unit configured to determine presence or absence of a sensor failure, based on a detection result of the first concentration sensor and a detection result of another of the first concentration sensors.

4. The electrosynthesis system according to claim 1, further comprising:

a second concentration sensor configured to detect a second concentration, which is a concentration of the other of the hydrogen gas and the carbon monoxide gas flowing through the generated gas flow path;

wherein the adjustment device adjusts the flow rate of the hydrogen gas and the flow rate of the carbon monoxide gas based on the first concentration sensor and the second concentration sensor.

5. An electrosynthesis system comprising an electrolysis device configured to perform electrolysis on a raw material gas containing carbon dioxide gas and water vapor, and thereby generate a generated gas containing hydrogen gas and carbon monoxide gas, a hydrocarbon synthesizing device configured to synthesize hydrocarbons based on the generated gas, and a generated gas flow path connected to the electrolysis device and the hydrocarbon synthesizing device, the electrosynthesis system further comprising:

a hydrogen gas storage device configured to be capable of storing the hydrogen gas;

a carbon monoxide gas storage device configured to be capable of storing the carbon monoxide gas;

a first concentration sensor configured to detect a first concentration, which is a concentration of one of the hydrogen gas and the carbon monoxide gas flowing through the generated gas flow path;

an adjustment device configured to adjust a flow rate of the hydrogen gas supplied from the hydrogen gas storage device to the generated gas flow path, and a flow rate of the carbon monoxide gas supplied from the carbon monoxide gas storage device to the generated gas flow path, based on a detection result of the first concentration sensor, in a manner so that the hydrogen gas and the carbon monoxide gas are supplied to the hydrocarbon synthesizing device at a predetermined concentration ratio;

a branching flow path configured to branch off from the generated gas flow path;

a separation device connected to the branching flow path, and configured to separate the hydrogen gas and the carbon monoxide gas from the generated gas that is supplied via the branching flow path;

a switching device configured to switch the connection with the electrolysis device to either one of the hydrocarbon synthesizing device or the separation device;

a second concentration sensor configured to detect a second concentration, which is a concentration of the other of the hydrogen gas and the carbon monoxide gas flowing through the generated gas flow path;

a merging flow path connected to the generated gas flow path and configured to cause the hydrogen gas and the carbon monoxide gas, the flow rates of which have been adjusted by the adjustment device, to merge in a common flow in the generated gas flow path; and a switching control unit configured to switch and control the switching device based on the first concentration sensor and the second concentration sensor;

wherein the hydrogen gas storage device stores the hydrogen gas that is separated by the separation device, the carbon monoxide gas storage device stores the carbon monoxide gas that is separated by the separation device, wherein the adjustment device adjusts the flow rate of the hydrogen gas and the flow rate of the carbon monoxide gas based on the first concentration sensor and the second concentration sensor, and the first concentration sensor and the second concentration sensor are provided in the generated gas flow path at a position more downstream than the merging portion where the merging flow path merges with the generated gas flow path.

* * * * *